US005792512A

United States Patent [19]

Duffy et al.

[11] Patent Number: 5,792,512

[45] Date of Patent: Aug. 11, 1998

[54] POWDER SPRAY APPARATUS AND METHOD FOR COATING THREADED ARTICLES AT OPTIMUM SPRAY CONDITIONS

[75] Inventors: Richard Duffy, Shelby Township; Eugene Sessa, Mt. Clemens; Raymond Oleskie, Shelby Township, all of Mich.

[73] Assignee: Nylok Fastener Corporation, MaComb, Mich.

[21] Appl. No.: 728,597

[22] Filed: Oct. 10, 1996

[51] Int. Cl.[6] ..... B05D 1/02; B05D 7/22; B05D 3/02

[52] U.S. Cl. ..... 427/181; 427/183; 427/195; 427/236

[58] Field of Search ..... 427/195, 236, 427/181, 183, 318

[56] References Cited

U.S. PATENT DOCUMENTS 3,995,074 11/1976 Duffy et al. ..... 427/181
5,221,170 6/1993 Duffy et al. ..... 411/428
5,262,197 11/1993 Pollizzi ..... 427/195
5,356,254 10/1994 DiMaio et al. ..... 411/302

*Primary Examiner*—Shrive Beck
*Assistant Examiner*—Fred J. Parker
*Attorney, Agent, or Firm*—Niro, Scavone, Haller & Niro

[57] ABSTRACT

A powder spray apparatus for coating threaded fasteners capable of operating at an optimum spray condition. Air supply and powder supply tubes communicate within an air/powder entrainment block. The jet diameter of the air supply tube is sized to provide an optimum spray condition at which a constant supply of powder is provided through a powder spray tube at an optimum powder density and velocity. These powder density and velocity conditions maximize the powder build rate on the threads of the fastener, and also increase production rates. The resulting coated fasteners exhibit a low torque scatter, and a highly uniform patch. A method for operating a powder spray apparatus at the optimum spray condition also forms part of the present invention.

7 Claims, 6 Drawing Sheets

POWDER SPRAY APPARATUS AND METHOD FOR COATING THREADED ARTICLES AT OPTIMUM SPRAY CONDITIONS

BACKGROUND OF THE INVENTION

The present invention generally relates to an improved process and apparatus for the manufacture of threaded articles having a useful coating applied to the threads. More particularly, the invention relates to an improved process and apparatus for spraying powder onto the threads of a fastener under optimum spray conditions, resulting in fasteners with a highly uniform powder coating.

Various methods and apparatus are disclosed for applying powder coatings to threaded articles. For example, the prior art discloses the formation of locking patches of resilient resin over a portion of the threads of threaded articles; the locking patch retards disengagement of the threaded fastener from a second, coupling threaded fastener by increasing the friction between the engagement surfaces of the two fasteners. This is referred to here in the specification as"patching" and the articles as"patched" articles. See, for example, U.S. Pat. No. 4,775,555, hereby incorporated by reference herein. The prior art also discloses a method and apparatus for applying a continuous Teflon powder coating onto substantially all of the threads of a threaded article to form a protective coating against a subsequently applied thread interfering contaminant (such as paint, anti-corrosion inhibitors, etc.) . This is referred to here in the specification as"coating" and the articles as"coated" articles. See U.S. Pat. No. 4,835,819, now Reissue Pat. No. Re. 33,776, also incorporated by reference herein. The methods and apparatus disclosed in those patents for applying coatings have proven highly successful; however, still further improvements are possible, and are disclosed here.

For purposes of the claims only, the terms"patching" and "coating" shall both be deemed encompassed by the term-"coating".

SUMMARY OF THE INVENTION

Advantages realized from known methods and apparatus for patching and coating fasteners are also realized by the present invention. Additional advantages not realized by the prior art methods and devices are also made possible by the present invention.

In one preferred embodiment, the invention relates to apparatus for applying a heat-softenable resin powder to threaded articles at an optimum spray condition. The apparatus includes a a support for the threaded articles, and a a regulated source of powder communicating with a powder supply tube. An air stream is maintained at a constant, preselected pressure of between about 20 and 60 p.s.i. flowing from a jet tube having a preselected diameter. The air stream from the jet tube and the powder from the powder supply tube mix within an air/powder entrainment block to form an air/powder stream. A plurality of powder spray passageways are provided, having first and second ends. The first end of each powder spray passageway periodically communicates with the air/powder stream, and the second end is positionable adjacent the article to be coated. The diameter of the jet tube is sized at between about 0.03 and 0.06 inches, to permit powder deposition onto the article at the optimum spray condition, thereby providing a substantially maximum powder build rate on the threaded article. A preselected amount of the resin powder is applied to the threads of the article to provide sufficient frictional engagement between the threaded article and a mating article so as to satisfy predetermined minimum torque removal requirements, such as the standards set forth in MIL-F-18240E or IFI-124.

Most preferably, the air flow rate through the powder supply tube is between about 20 and 45 SCFH, and the powder density through the powder supply tube is less than about 2 pounds/cubic-foot.

In a particularly preferred embodiment, a rotating carriage is used, and at least portions of the powder spray tubes are located within the rotating carriage and positioned in a radially outward direction relative to the rotating carriage.

In another preferred embodiment, the first end of each powder spray passageway includes a slotted channel with a tapered throat, and at least a portion of the first ends of adjacent powder spray passageways are contiguous. Also, one or more strategically located vacuum collectors can be positioned for removing excess powder.

In another preferred embodiment of the invention, the articles are internally threaded fasteners with their lengths oriented vertically, and the second end of each powder spray tube includes a spray nozzle. A cam mechanism is used to provide the powder spray tubes with a predetermined, periodic up and down motion to move the spray nozzles to different vertical positions relative to the threads of the fasteners.

The invention also consists of a process for applying a heat-softenable resin powder to threaded fasteners at an optimum spray condition. The invention includes the steps of providing a support for the threaded fasteners, an air/powder entrainment block, and an air supply tube in communication with a source of pressurized air. The air supply tube has a preselected jet inside diameter of between about 0.03 and 0.06 inches. A powder supply tube is also provided, and has a regulated source of powder. The air and powder supply tubes communicate within the air/powder entrainment block to provide an aspirated powder stream. The air pressure within the jet tube is adjusted to between about 20 and 60 p.s.i. to achieve a substantially constant flow rate of between about 20 and 50 SCFH for the aspirated powder stream. The rate of powder flowing from the regulated source to the powder supply tube is also adjusted.

One or more powder spray tubes are provided in communication with the aspirated powder stream. Each powder spray tube terminates in a powder spray nozzle positionable adjacent the fastener threads. The threaded fasteners are then sprayed to permit powder deposition onto the fastener threads at the optimum spray condition. The powder rate from the regulated source is adjusted to provide a powder density through the air supply tube of less than 2 pounds/cubic-foot, and the air pressure within the jet tube is adjusted to provide a substantially maximum powder build rate on the threaded article, and to also provide the threaded fasteners with an installation torque which is within a predetermined range.

In the particularly preferred embodiment, the jet tube area is about 0.0022 square inches. Also, a rotating carriage is provided, with at least portions of the powder spray tubes being located within the rotating carriage and positioned in a radially outward direction relative to the rotating carriage. The fasteners are preferably heated prior to powder deposition.

It is also preferred to introduce powder to the power supply tube at a preselected and adjustable, but substantially constant rate. To do this, a metering device can be used that has a rotating auger whose speed can be varied to change the rate of introduction of the powder to the powder supply tube.

BRIEF DESCRIPTION OF THE DRAWINGS

The novel features which are characteristic of the present invention are set forth in the appended claims. The invention itself, however, together with further objects and attendant advantages, will be best understood by reference to the following description taken in connection with the accompanying drawings in which:

DESCRIPTION OF THE PREFERRED EMBODIMENTS

Figure 1:
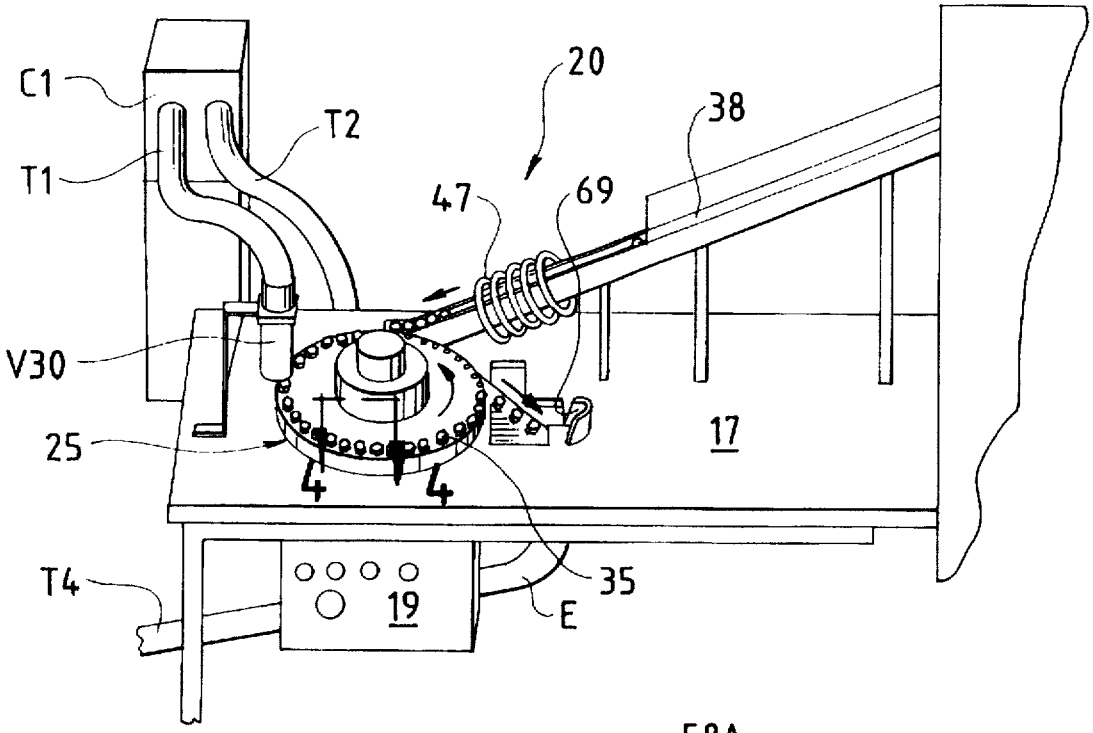
FIG. 1 is a perspective view of one embodiment of the present invention viewed within its working environment.
Figure 2:
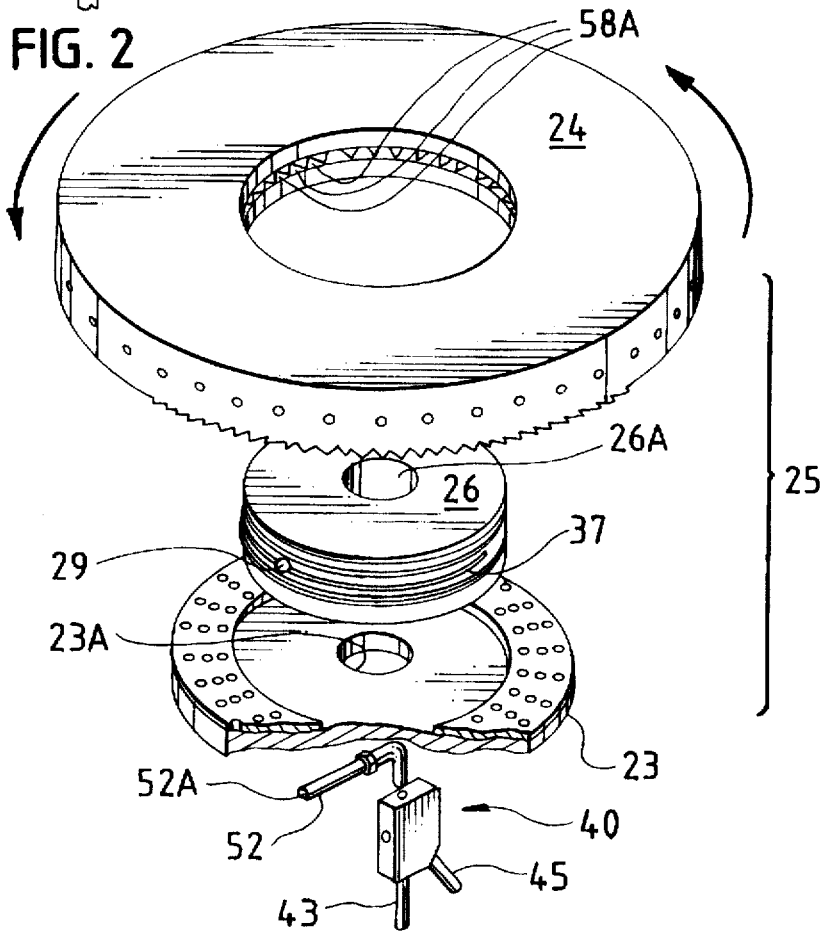
FIG. 2 is an exploded parts view of the rotating carriage, support elements and associated air/powder entrainment block and tubes of a preferred embodiment of the invention.

Referring first to FIGS. 1 and 2, an apparatus for manufacturing self-locking threaded articles 35, generally designated as 20, is mounted on table 17, which includes a suitable control panel 19. In the preferred embodiment shown in FIGS. 1–3, known as a "dial"-type nut patching machine, a spray assembly, generally designated as 25, includes a rotating table or carriage 24 carrying horizontal powder spray tubes, a fixed centerpost 26, an annular support plate 23, and a powder/air entrainment block 40. However, those of ordinary skill in the art will appreciate that the present invention can be applied to spray machines which orient fasteners sequentially in line, rather than on a rotating carriage.

Referring to FIGS. 1 and 2, the threaded articles, such as the internally threaded fasteners 35 shown, are supplied to rotating carriage or horizontal tube ring 24 from downwardly inclined loading chute 38. Carriage 24 includes horizontal tubes for carrying powder (described below) and a locating plate 59 (FIG. 3) with notches 59A into which fasteners 35 are positioned; fasteners 35 rest on support plate 64 (see FIG. 11). During passage down the chute, threaded articles 35 are preheated by induction coil 47 in a manner well known in the art prior to being deposited onto fastener support plate 64.

Figure 3:
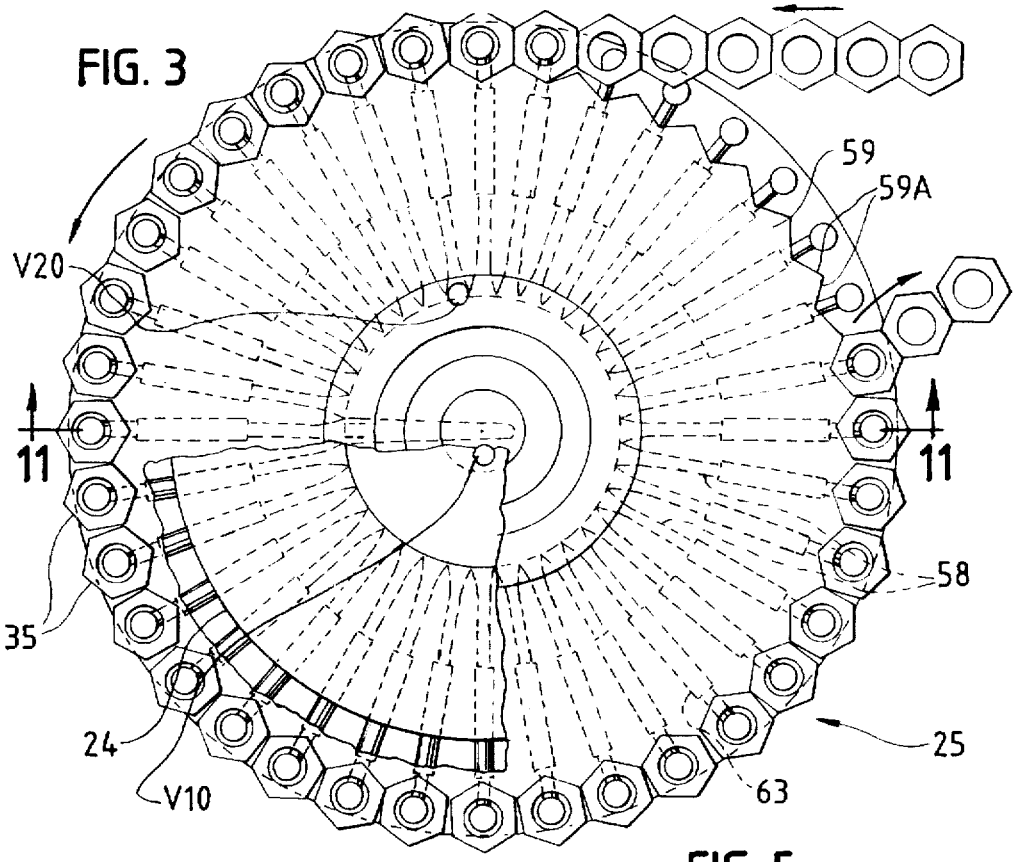
FIG. 3 is a top view of the article locating and support plates and the rotating carriage shown in FIG. 2.
Figure 11:
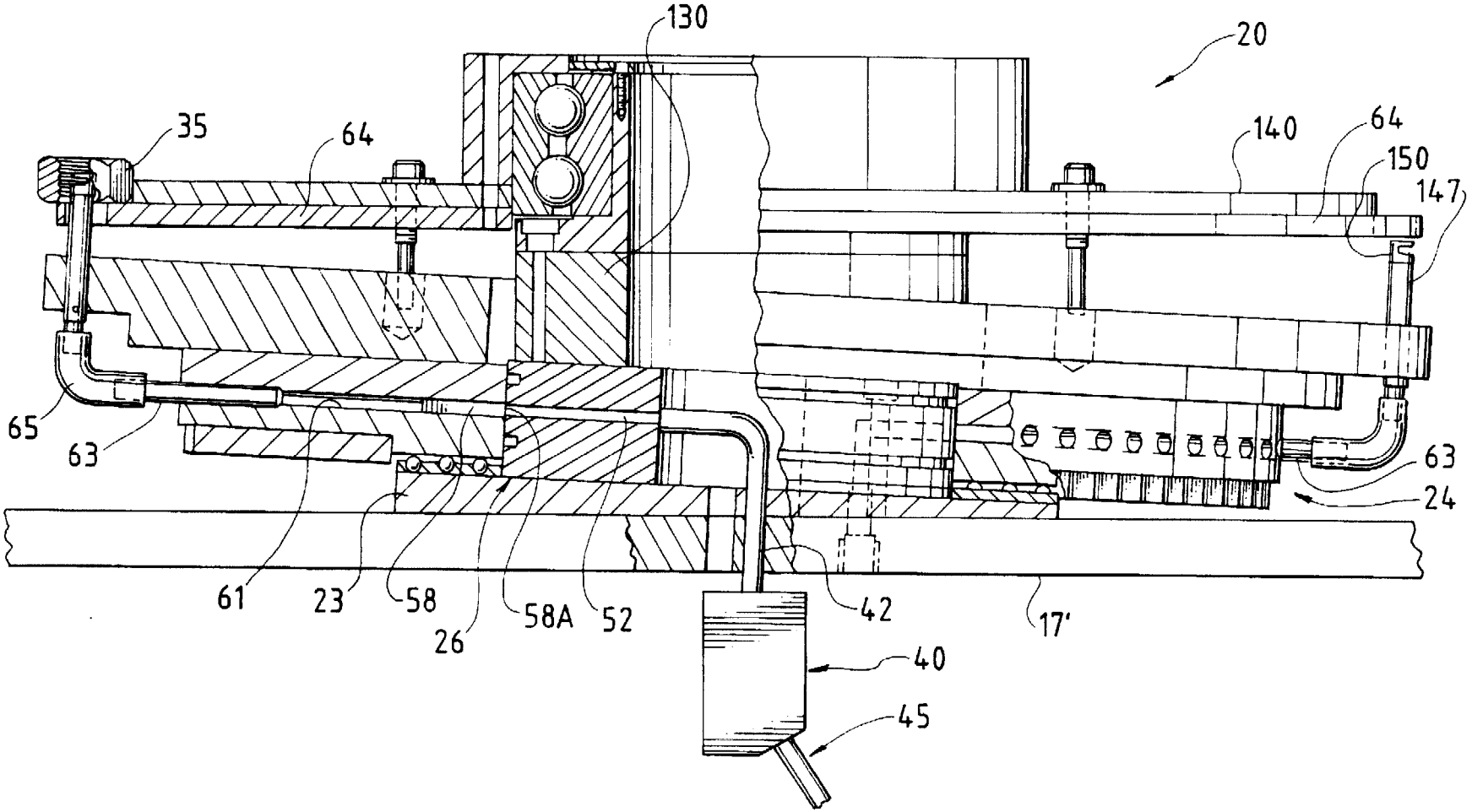
FIG. 11 is a side view, in partial cross-section, of one preferred embodiment of the present invention, taken along section lines 11—11 of FIG. 3.

Referring still to FIGS. 1–3, support plate 23 has an upper surface that is sloped, as shown in FIGS. 2 and 11, for raising and lowering the spray tube, as more specifically described below.

Figure 5:
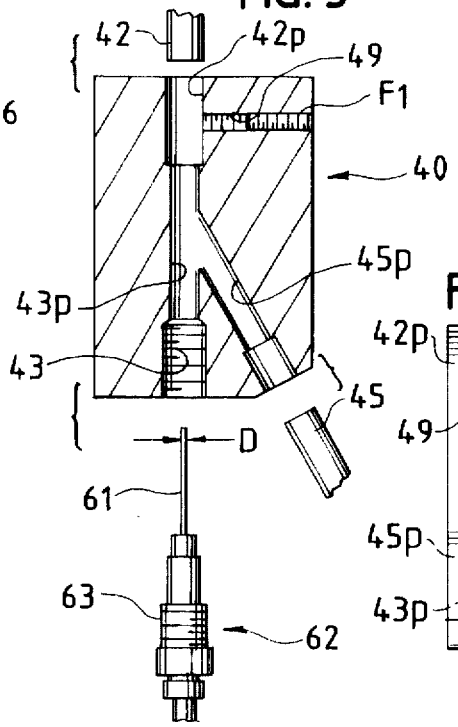
FIG. 5 is an exploded cross-sectional side view of the air/powder entrainment block of the invention.
Figure 6:
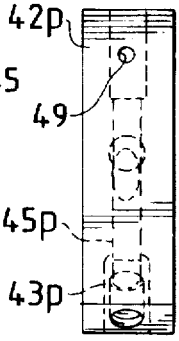
FIG. 6 is an end view of the air/powder entrainment block.
Figure 7:
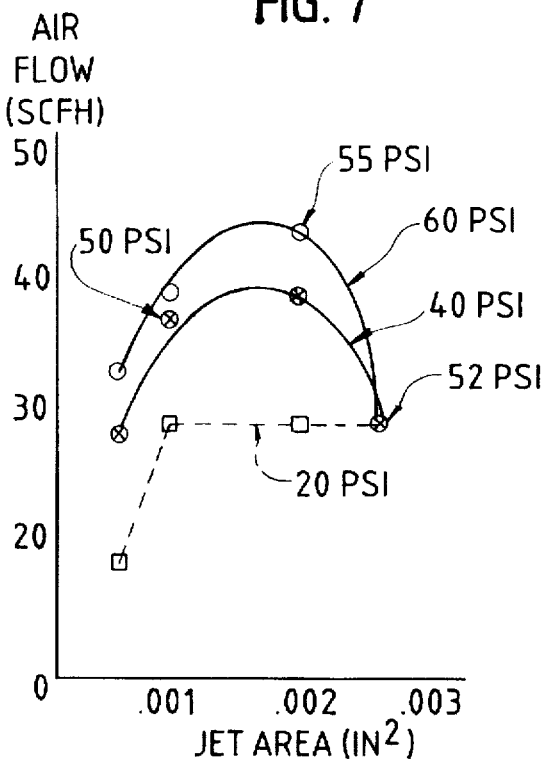
FIGS. 7 and 8 illustrate graphical data showing benefits of the present invention.

Referring now to FIGS. 2 and 5, air/powder entrainment block 40 includes various passageways 42*p*, 43*p* and 45*p* which respectively communicate with air/powder delivery tube 42, air jet 61 and powder supply tube 45, as shown. Entrainment block 40 also includes passageway 49 accommodating set screw F1 for securing tube 42 in position. The tubing associated with entrainment block 40 is preferably made of stainless steel for longer, rust-free, wear.

Figure 18:
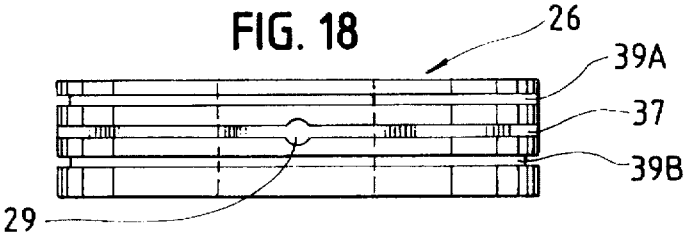

Referring to FIGS. 2 and 16–18, stationary ring or centerpost 26 includes a middle slot 37 and annular slots 39A and 39B. As shown in FIG. 18, slot 37 communicates with aperture 29 (which, in turn, communicates with tube 52 connected to air/powder entrainment block 40, as shown in FIG. 2), allowing channel 52 (FIG. 9) to provide an increased spray time for larger fasteners, so that a patch with a sufficient thickness can be provided. Rings 39A and 39B communicate with one or more vacuum collectors, described below, to remove powder that accumulates in the clearance between rotating carriage 24 and stationary ring 26.

Figure 4:
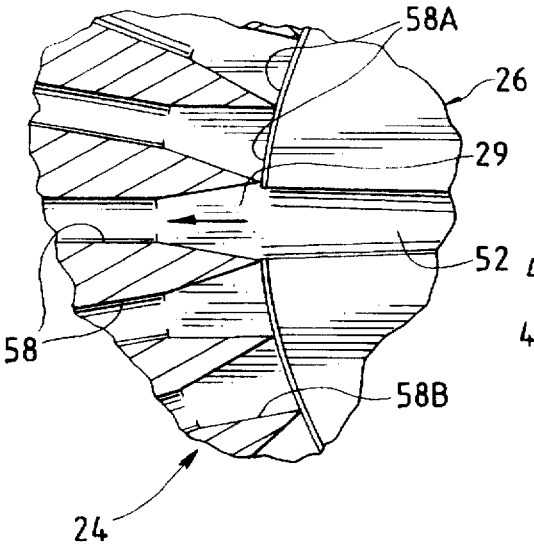
FIG. 4 is an exploded, partial view taken along section lines 4—4 of FIG. 1.

To assemble entrainment block 40 to centerpost 26, air/powder delivery tube 42 is inserted through disc aperture 23A and also through inner ring aperture 26A. Tube 52 is inserted through aperture 29 on the outer surface of ring 26, and into ring aperture 26A, as shown in FIGS. 2, 4 and 11. Tube 52 is flexibly connected to tube 42. Tube ring or carriage 24 continuously rotates in the direction of the arrows shown in FIG. 2. As the carriage rotates, aperture 29 periodically communicates with ends 58A of radially extending spray channels 58. Spray channels 58 are positioned within carriage 24, as best shown in FIGS. 2, 3 and 11.

Referring now to FIGS. 2 and 5, a constant, metered source of powder (not shown) is in continuous communication with powder supply tube 45. A source of pressurized air (also not shown) is provided, and flows up through a compression fitting, generally designated as 62. Compression fitting 62 may include, for example, a ¼-inch (OD) polyflow, ⅛-27 NPT connector 63, fitted to jet tube 61. Jet tube 61 is inserted within air supply tube 43*p*, and externally threaded connector 63 mates with internally threaded passage 43. Compressed air flowing through jet tube 61 creates negative pressure in powder supply tube 45, drawing powder and air into block 40 at the junction of the air and powder supply passageways 43*p* and 45*p*. The aspirated powder stream passes into air/powder delivery tube 42 (FIGS. 2 and 3), which is installed in passageway 42*p*.

Figure 9:
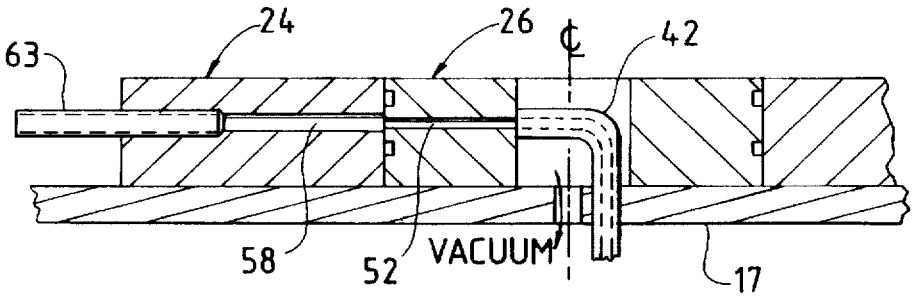
FIG. 9 is a side cross-sectional view of one preferred embodiment of the rotating carriage and associated powder supply tubes.
Figure 10:
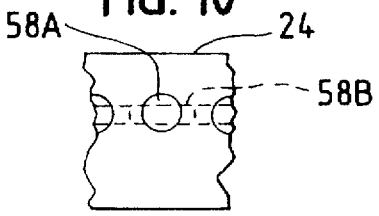
FIG. 10 is a front view of the powder supply channel in the rotating carriage, showing its transition from a rectangular to a round cross-section.

Since powder is supplied from a powder source at a constant rate, preferably using the device described below, air and powder flows through powder supply tube 45 at a constant rate when the air pressure through jet tube 61 is maintained at a predetermined constant pressure. Referring now to FIGS. 3 and 4, the air-entrained powder passes through air/powder delivery tube 42 and connecting tube 52, and into tapered throat 58B of powder spray channel 58. As best shown in FIGS. 9 and 11, the powder passes through the length of powder spray channel 58, through connecting tube 63, through flexible connector 65, into vertical spray tube 147 and out spray nozzle 150 onto threaded article 35. After a threaded fastener has been spray coated, it can be conveyed down ramp 69 and into an exit tube E, as shown in FIG. 1.

It is important that throats 58B of channels 58 be tapered, and that adjacent throats 58B be contiguous, as shown in FIG. 4, to reduce air back-pressure. Otherwise, if the pressurized powder/air stream contacts the ring structures between powder spray channels 58, this will generate back-pressure and turbulence, interfering with powder flow and, thus, the powder deposition process. For the same reasons of reducing air back pressure and promoting laminar flow, it is also desirable to maintain a constant cross-sectional area in the powder/air flow passageways. These internal passageways should also be as large as possible, consistent with the size of the fastener to be sprayed, to obtain the maximum patch build rate.

It has been discovered that there is an optimum powder density (in air) and an optimum powder velocity, together referred to here as an "optimum spray condition", for maximizing patch build rate. The optimum spray condition is achieved by properly sizing jet tube 61. It was found that at the "optimum spray condition" a substantially maximum entrained air volume/time and a substantially maximum patch build rate can be achieved, as described below.

Testing results operating the disclosed structure at the optimum spray condition are graphically shown in FIGS. 7, 8, 12, 15 and 19. Air flow rate and resulting torque were measured as a function of varying jet area at various air pressure levels. When the power spray apparatus of the present invention is operating at the optimum spray condition, it was discovered that there is a particular jet area (about 0.0022 inches-squared) for which, at all air pressures tested, patched fasteners of differing sizes exhibit an extraordinarily uniform patch build, referred to here as a low "torque scatter". In other words, installation torques vary only slightly from fastener to fastener. Tests indicate that a decrease in torque scatter of as much as 40% or more can be achieved when operating the invention at the optimum spray condition, as compared to the torque scatter of fasteners produced by assignee's own "Universal" fastener coating machines, made according to U.S. Pat. No. 5,362,327.

Operation at this maximum patch build rate or optimum spray condition has also been found to increase production rates. In other words, a shorter powder application time is necessary to produce a patch build providing a given torque level. For example, operation of assignee's older "dial" machines made according to U.S. Pat. Nos. 3,995,074 and 4,054,688 yields a production rate of about 200 pieces/minute for M10 fasteners, whereas a similar "dial" machine made according to the present invention and operated at the optimum spray condition yields production rates of up to 350 pieces/minute for the same size fasteners.

The inventors have experimentally verified their results. As one example, referring to FIG. 7, at an air pressure of 40 psi, and a jet tube area of about 0.0022 inches-squared, it can be seen that a substantially maximum flow rate per time, V/T, of about 40 standard cubic feet/hour (SCFH) was achieved. This V/T rate is a measure of the air flow per time through tube 45. Here is the jet tube diameter, in inches (and the corresponding area in square inches, in parentheses), for various points plotted on FIG. 7: 0.033 (0.0008); 0.040 (0.0012); 0.053 (0.0022); 0.054 (0.0023); and 0.060 (0.0028).

Figure 8:
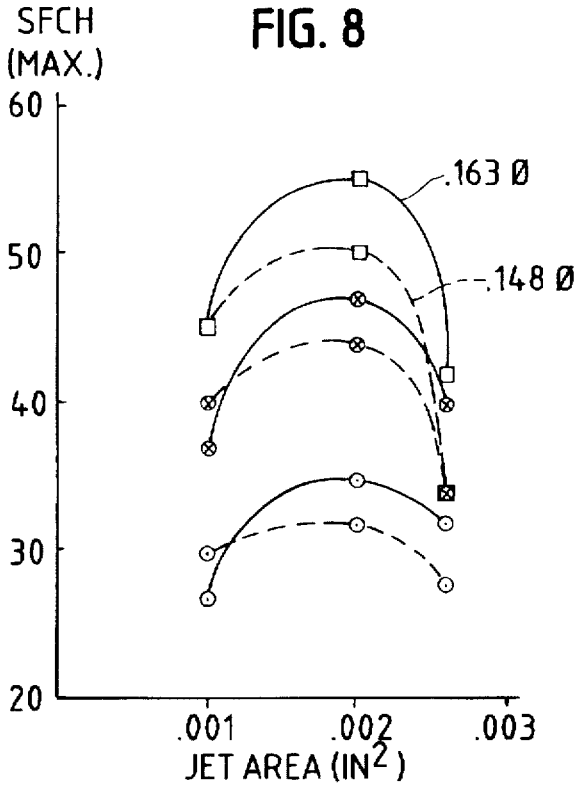

As another example, referring to FIG. 8, the solid lines show test results with an ID for tube 63 (FIG. 11) of 0.163 inches, while the dotted lines show test results with an ID for tube 63 of 0.148 inches. Again, a substantially maximum flow rate was achieved at varying jet tube air pressures, for a particular jet tube area of about 0.0022 inches-squared. FIG. 8 shows that increased air flow rates, and thus faster patch build rates, can be achieved using larger spray tube diameters.

Figure 12:
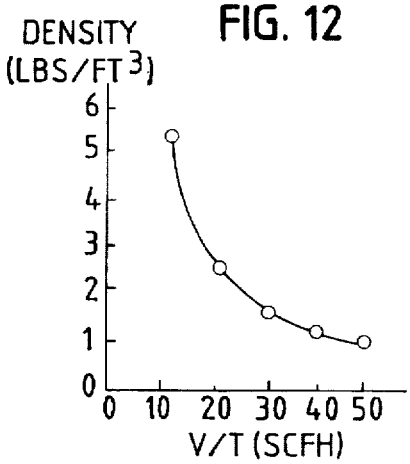
FIG. 12 illustrates further graphical data showing the benefits of the present invention.

FIG. 12 demonstrates the drop in density with increased air flow rate. Surprisingly, the inventors discovered that better patch build rates were achieved at lower densities, less than about 2 pounds/cubic-foot, and most preferably in a range of about 1 to 1.5 pounds/cubic-foot or less. (Powder density is calculated, for example, at tube 45.) This discovery ran counter to years of past experience by the inventors using various machines for applying coatings to threaded fasteners. FIG. 12 assumes air flow through jet tube 61 is negligible compared to air flow through tube 45.

Figure 15:
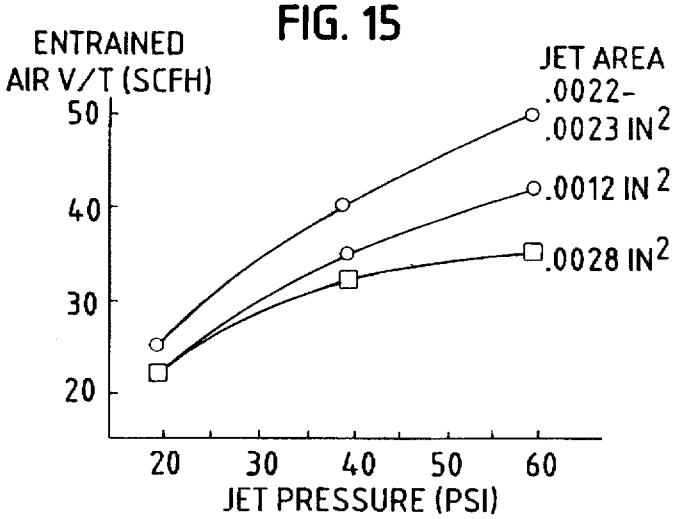
FIG. 15 illustrates further graphical data showing the benefits of the present invention.
Figure 16:
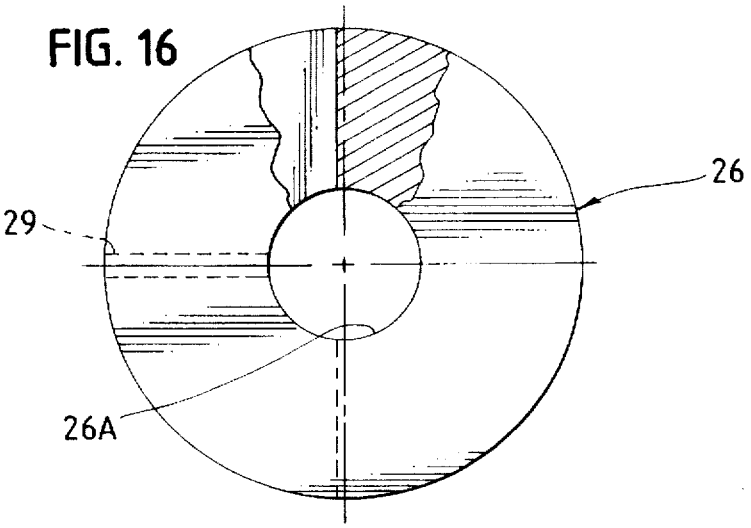
FIGS. 16–18 are partial top, side and front sectional views, respectively, of the centerpost, including associated annular slots.
Figure 17:
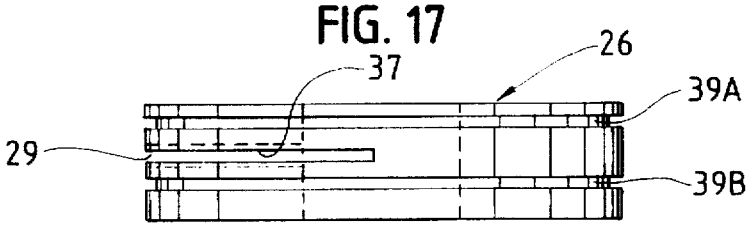

As a further example, FIG. 15 shows, for a constant metered powder flow rate, the variation of powder density with air jet tube cross-sectional area. FIG. 15 clearly demonstrates the surprising result that the air flow rate actually decreases when the jet tube diameter is increased above the jet tube diameter used in the optimum spray condition.

Figure 19:
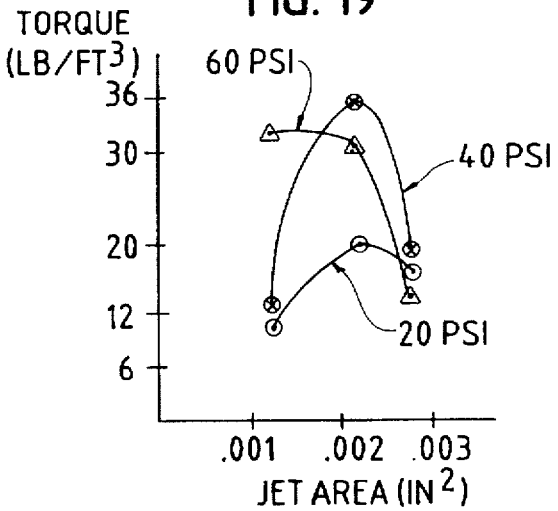
FIG. 19 illustrates still further graphical data showing the benefits of the present invention.

As yet another example, FIG. 19 shows the variation in torque with jet tube size. FIG. 19 illustrates that the maximum torque was consistently achieved for a particular jet tube area, at varying pressures. This jet tube area, again, is about 0.002 square-inches.

As can be seen, operation at the optimum spray condition results in a more efficient use of powder, and allows the use of a lower application air pressure, resulting in a more economical powder deposition process. This is significant since it is important to transport powder with the minimum amount of air necessary to keep the powder suspended. A more forceful air stream generates more spattered powder on the article to be sprayed, resulting in a less efficient process and a more unsightly product.

As those of ordinary skill in the art will appreciate, the speed of table or carriage 24 should be adjusted to provide sufficient time to pre-heat and to spray the fasteners, given the specific application. As can be seen, in the preferred embodiments optimum spray conditions were achieved when air pressures were in the range of 20–60 psi, the jet area was about 0.001–0.003 inches-squared, and the air flow range was about 20–50 SCFH (and, more preferably, between about 20–45 SCFH).

Generally, the steps to be taken to provide powder application at an optimum spray condition are as follows. First, based on the disclosure here, the proper jet tube inner diameter is selected (i.e., about 0.053 inches, or a jet tube area of about 0.0022 square inches). Next, the air pressure in the jet tube is adjusted to a value between 20 and 60 p.s.i., and the powder flow rate from the metering device is also adjusted, consistent with patch build rate and required torque value to be achieved.

The powder deposition process of the present invention will now be described in more detail. Powder is continuously supplied through air/powder delivery tube 42 and connecting tube or channel 52 to powder spray channel 58. As tapered throat 58B of channel 58 first passes in front of aperture 29, a light stream of powder is applied to the threaded article; the powder stream gradually increases in volume until the entire diameter of aperture 29 is within the throat, and then gradually decreases in volume as the throat edge passes aperture 29. Thus, a light coating of powder is first applied to the threads of the article, and helps catch or retain the subsequent heavier application of powder; finally, another light powder coating "tops off" the heavier application.

It will be appreciated that tube 52 can take various forms. For example, it may consist of a round tube. Alternatively, as shown in FIG. 9 tube 52 may consist of a channel with two sides, each with a width equal to the tube ID. At the interface or discharge end, the channel can be angled outwardly to a width which is a multiple of tapered throat 58B (i.e., 1×, 1.5×, 2×,etc.), to provide increased powder application time.

A powder metering device is preferably used to regulate the flow of powder passing into powder supply tube 45. In one preferred embodiment, an AccuRate® volumetric powder metering unit, available from Schenck Accurate of White Water, Wisconsin, is used to provide a constant, regulated powder flow rate. This metering unit includes a rotating auger whose rotational rate can be varied to selectively increase or decrease the regulated rate of powder flow. The provision of a constant and regulated powder flow aids in the formation of the highly uniform patch and low torque scatter provided by the present invention.

It is also preferred to provide vacuums in selected locations to collect any blow-back powder and to maintain powder deposition apparatus 20 in a clean and smoothly running condition. In a preferred embodiment, at least two Vaccon® material transfer units are used. Referring to FIG. 3, vacuum unit V10 can be applied to the central cavity to clean out residual powder in the supply and delivery tubes, and also to collect any blow-back powder that collects in slot 37. Tubes T1 and T2 transport the residual powder collected by the vacuum units to a powder collector Cl. Vacuum unit V20 is applied to annular slots 39A and 39B to keep the bearing surface between rotating, horizontal tube ring 24 and stationary centerpost 26 free from powder. Vacuum nozzle V30 (FIG. 1), with powder collector C1, provides upward air flow through the threaded article and collects excess sprayed powder.

Referring now to FIG. 11, one preferred embodiment for patching fasteners is shown. Powder spray apparatus 20 includes a table or other base 17, an angled supporting plate 23, a bearing support spacer 130, a support plate 64, and a locating plate 140. Together these components cause vertical spray tube 147 and spray nozzle 150 to oscillate up and down relative to fastener 35 as carriage 24 turns about centerpost 26, in a manner also detailed in U.S. Pat. Nos. 5,221,170 and 4,775,555, each of which are hereby incorporated by reference.

Figure 13:
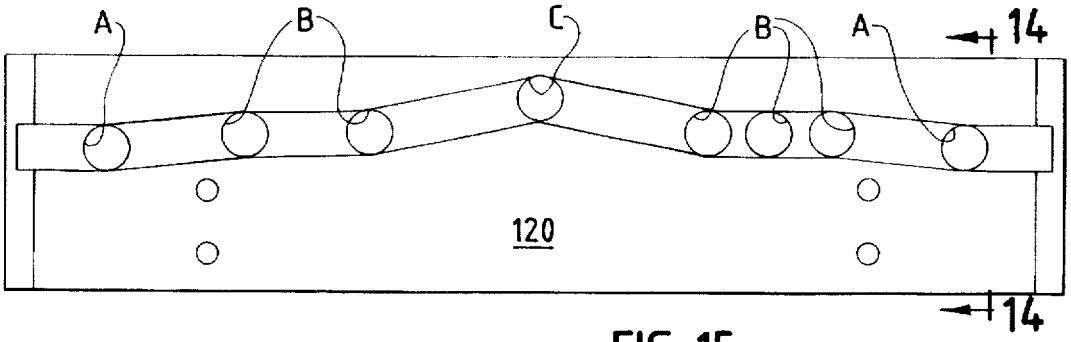
FIG. 13 is an elevational view of a two-stage cam element according to a second preferred embodiment of the present invention.
Figure 14:
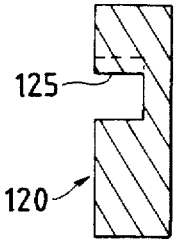
FIG. 14 is an end view of FIG. 13.

A second preferred embodiment of the apparatus associated with powder spray channel 58, that will permit spray nozzles 150 to oscillate up and down relative to an internally threaded article to be coated, will now be described. Referring to FIGS. 13 and 14, a two-stage cam element, generally designated as 120, is shown and can be used to provide the up-and-down movement of spray nozzle 150. The cam surface is preferably configured as shown to permit a three-stage movement of the spray nozzle. Thus, cam 120 permits powder spray tube 150 to move vertically upward between at least three positions: a first position ("A") in which the upper end of the spray tube lies beneath the article to be sprayed; a second position ("B") in which the upper end lies within the article opening; and a third position ("C") in which the upper end lies within the article opening at a vertical position located above the second position. Conversely, movement of the upper end of the spray tube can be sequentially reversed, as well, so that the upper end can move from the third position to the second position and then to the first position.

Another preferred aspect of the two-stage cam embodiment is i disclosed in U.S. Pat. No. 4,888,214, incorporated herein by reference (see, e.g., FIGS. 7–9 of that patent). Use of this mechanism permits the application of the coating material to either all the threads or selected threads of the threaded article. (It will be understood that the cam structure 120 disclosed in FIGS. 13 and 14 will replace cam block 52 of U.S. Pat. No. 4,888,214, and will be operative with the following elements, all of which can remain virtually identical to those disclosed in FIG. 3 of U.S.

Pat. No. 4,888,214: support member 50, upwardly extending arm 53, cam follower 44, mounting block 40, and shaft 42.)

Referring still to FIGS. 13 and 14, cam block 120 possesses square groove 125. In the first stage of the two-stage cam movement, movement of a roller cam follower (element 44, associated with an elongated tube, element 34, as shown in FIG. 3 of the '214 patent), follows the contours of square groove 125 and serves to raise the spray tube from an initial position (depicted as the circle labeled "A" in FIG. 13) to second and third vertical positions within the internally threaded article (circles B and C), while the article is being sprayed.

While the preferred embodiment is described with reference to the patching of articles, the principles of the present invention can also be used to provide coated articles (i.e., articles with a coating on substantially all of the threads of the article that will protect the threads from the deposition of thread interfering contaminants, such as paint, as disclosed in U.S. Pat. No. Re. 33,766, also incorporated herein by reference).

Also, while the preferred embodiment shown in the drawings is used to coat or patch internally threaded fasteners, such as nuts, those of ordinary skill in this art will understand that the principles of the present invention can easily be modified to coat or patch externally threaded fasteners, such as bolts, as well.

For example, the principles of the present invention can be used to operate a machine for patching or coating externally threaded fasteners, such as described in U.S. Pat. No. Re. 28,812, also incorporated by reference herein.

It will be understood that the invention may be embodied in other specific forms without departing from its spirit or central characteristics. The present examples and embodiments, therefore, are to be considered in all respects as illustrative and not restrictive, and the invention is not to be limited to the details given here.

We claim:

1. A process for applying a heat-softenable resin powder to threaded articles at an optimum spray condition, comprising the steps of:

providing a support for the threaded articles together with an air/powder entrainment block, and an air supply tube in communication with a source of pressurized air;

selecting a jet diameter for the air supply tube of between about 0.03 and 0.06 inches, the jet diameter having an area of about 0.0022 square inches;

providing a powder supply tube in communication with a source of powder, the air and powder supply tubes communicating within the air/powder entrainment block to provide an aspirated powder stream;

adjusting the air pressure through the jet diameter to between about 20 and 60 p.s.i. to achieve a substantially constant flow rate of between about 20 and 50 SCFH for the aspirated powder stream;

adjusting the rate of powder flowing from the powder source to the powder supply tube;

providing one or more powder spray tubes in communication with the aspirated powder stream, each of the one or more powder spray tubes terminating in a powder spray nozzle positionable adjacent the article threads;

adjusting the air pressure through the jet diameter to provide a substantially maximum powder build rate on the threaded article; and spraying the threaded articles to permit powder deposition onto the article threads at the optimum spray condition, such that the threaded articles frictionally engage mating articles so as to provide a substantially maximum and relatively uniform installation torque corresponding to the selected jet diameter.

2. The process of claim 1, wherein the installation torque is within a range corresponding to that either MIL-F-1824OE or IFI-124.

3. The process of claim 1, further comprising the step of locating at least portions of the powder spray tubes in a radially outward direction within a rotating carriage.

4. The process of claim 1, further comprising the step of heating the threaded fasteners prior to powder deposition.

5. The process of claim 1, further comprising the step of introducing powder to the powder supply tube at an adjustable but substantially constant rate.

6. The process of claim 4, wherein the step of introducing powder to the powder supply tube at a substantially constant rate is accomplished using a metering device having an adjustable output rate.

7. The process of claim 1, further comprising the step of adjusting the powder rate from the powder source to provide a powder density through the air supply tube of less than 2 pounds/cubic foot.

* * * * *